US008337340B2

(12) United States Patent
Clark

(10) Patent No.: US 8,337,340 B2
(45) Date of Patent: Dec. 25, 2012

(54) BASES, HOME PLATES, AND PITCHER'S RUBBERS FOR USE ON SYNTHETIC TURF INFILL MATERIAL

(75) Inventor: Burton Scott Clark, Delhi, NY (US)

(73) Assignee: Sportsfield Specialties, Inc., Delhi, NY (US)

( * ) Notice: Subject to any disclaimer, the term of this patent is extended or adjusted under 35 U.S.C. 154(b) by 0 days.

(21) Appl. No.: 12/371,848

(22) Filed: Feb. 16, 2009

(65) Prior Publication Data

US 2010/0210382 A1 Aug. 19, 2010

(51) Int. Cl.
*A63B 71/00* (2006.01)

(52) U.S. Cl. ..... 473/497; 473/452; 473/499

(58) Field of Classification Search ..... 473/422, 473/452, 497–501
See application file for complete search history.

(56) References Cited

U.S. PATENT DOCUMENTS

| | | | | |
|---|---|---|---|---|
| 3,181,863 | A * | 5/1965 | Nellermoe | 473/499 |
| 4,266,768 | A * | 5/1981 | Hall | 473/501 |
| 4,448,414 | A | 5/1984 | Gutierrez | 273/25 |
| 4,531,733 | A | 7/1985 | Hall | 273/25 |
| 4,542,901 | A | 9/1985 | Fatool et al. | 273/25 |
| 4,817,946 | A | 4/1989 | Velasquez | 273/25 |
| 4,881,735 | A | 11/1989 | Orsatti | 273/25 |
| 5,154,961 | A | 10/1992 | Reuben | 428/82 |
| 5,564,695 | A | 10/1996 | Christensen | 273/25 |
| 5,590,874 | A | 1/1997 | Hall | 473/501 |
| 6,077,175 | A | 6/2000 | Fearnow | 473/468 |
| 6,786,842 | B1 | 9/2004 | Nasiatka | 473/499 |
| 7,254,874 | B2 | 8/2007 | Duffy | 24/452 |
| D558,846 | S | 1/2008 | Hernandez, Jr. | D21/780 |
| 7,717,813 | B2 * | 5/2010 | Sinovich | 473/499 |
| 2004/0142776 | A1 | 7/2004 | Johnson | 473/499 |
| 2008/0108460 | A1 | 5/2008 | Sinovich | 473/499 |
| 2008/0171621 | A1 | 7/2008 | Jacobson | 473/499 |
| 2008/0194361 | A1 * | 8/2008 | Hadar | 473/499 |
| 2009/0124436 | A1 * | 5/2009 | Nimmons | 473/501 |
| 2009/0270206 | A1 * | 10/2009 | Massaro | 473/497 |

OTHER PUBLICATIONS

Tomark Sports—Multisport Equipment—Fall 2009, p. 92, Cleat & Spike Cleaner—Item No. Mm-K12013.*

* cited by examiner

*Primary Examiner* — Mitra Aryanpour
(74) *Attorney, Agent, or Firm* — Heslin Rothenberg Farley & Mesiti P.C.

(57) ABSTRACT

A base, a home plate, and a pitcher's rubber for use on synthetic turf infill material for playing baseball includes an upper portion in the shape of the at least one of base, home plate, and a pitcher's rubber, and a lower portion comprising a plurality of downwardly-depending projections extending about ½ inch to about 1 inch below a bottom surface of the upper portion. The plurality of downwardly-depending projections is engageable with the synthetic turf infill material for playing baseball.

53 Claims, 8 Drawing Sheets

BASES, HOME PLATES, AND PITCHER'S RUBBERS FOR USE ON SYNTHETIC TURF INFILL MATERIAL

FIELD OF THE INVENTION

This invention relates generally to bases, home plates, and pitcher's rubbers, and more particularly to bases, home plates, and pitcher's rubbers for use on synthetic turf for playing baseball and softball.

BACKGROUND OF THE INVENTION

Over the past years, the synthetic turf industry has grown dramatically with the introduction of infill turf. These synthetic turf fields are much more affordable than earlier turfs and are more player friendly as well. In many situations these fields are used for multiple sports and it is important that when baseball or softball are not being played that the bases can be removed allowing other sports to be played.

Until now there were two main categories of bases that could be used in these applications. First, there are in-ground bases that utilize some sort of sleeve anchored into the field sub-base. These bases are often used by higher level programs. They are not versatile in that they can only be used in the location that the anchor is installed, they do not allow the flexibility to use other areas or other fields when scheduling is tight. Second, there are also simple rubber bases that are placed on top of the turf. These bases allow more flexibility, but they move out of place with even the slightest contact.

There is a need for further bases, home plates, and pitcher's rubbers, and more particularly to bases, home plates, and pitcher's rubbers for use on synthetic turf for playing baseball and softball.

SUMMARY OF THE INVENTION

In a first aspect, the present invention provides a device for use as at least one of a base, a home plate, and a pitcher's rubber on a synthetic turf infill material for playing baseball. The device includes an upper portion in the shape of the at least one of base, home plate, and a pitcher's rubber, and a lower portion comprising a plurality of downwardly-depending projections extending about ½ inch to about 1 inch below a bottom surface of the upper portion. The plurality of downwardly-depending projections is engageable with the synthetic turf infill material for playing baseball.

In a second aspect, the present invention provides a method of forming a device for use as at least one of a base, a home plate, and a pitcher's rubber on synthetic turf infill material for playing baseball. The method includes providing an upper portion in the shape of the at least one of base, home plate, and a pitcher's rubber, providing a lower portion comprising a plurality of downwardly-depending projections, the plurality of downwardly-depending projections is engageable with the synthetic turf infill material for playing baseball, and attaching the lower portion to the upper portion so that the downwardly-depending projections extend about ½ inch to about 1 inch below a bottom surface of the upper portion.

In a third aspect, the present invention provides a home plate for use on synthetic turf infill material for playing baseball. The home plate includes an upper portion, and a lower portion comprising a plurality of downwardly-depending projections extending about ½ inch to about 1 inch below a bottom surface of the upper portion. The downwardly-depending projections comprising a density of about 1 projection to about 2 projections per square inch, and the plurality of downwardly-depending projections is engageable with the synthetic turf infill material for playing baseball.

In a fourth aspect, the present invention provides a pitcher's rubber for use on synthetic turf infill material for playing baseball. The pitcher's rubber includes an upper portion, and a lower portion comprising a plurality of downwardly-depending projections extending about ½ inch to about 1 inch below a bottom surface of the upper portion. The downwardly-depending projections comprising a density of about 1 projection to about 2 projections per square inch and the plurality of downwardly-depending projections is engageable with the synthetic turf infill material for playing baseball.

In a fifth aspect, the present invention provides a kit for playing baseball on a synthetic field. The kit may include a plurality of devices as noted above defining a home plate, three bases, and a pitcher's rubber.

In a sixth aspect, the present invention provides a baseball field which includes a synthetic field, and a plurality of devices as noted above defining a home plate, three bases, and a pitcher's rubber.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and the accompanying drawings in which:

DETAILED DESCRIPTION OF THE INVENTION

Figure 1:
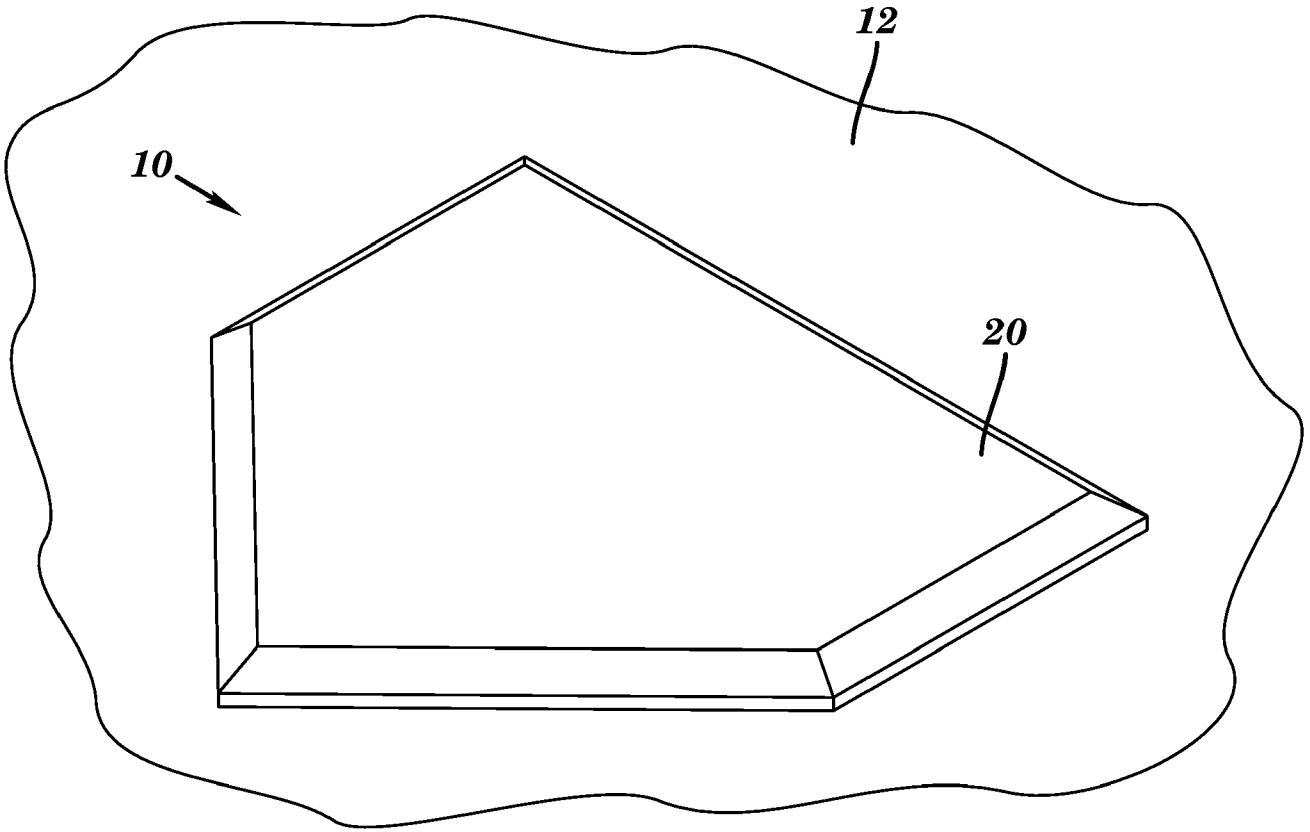
FIG. 1 is a front perspective view of a home plate in accordance with the present invention.
Figure 2:
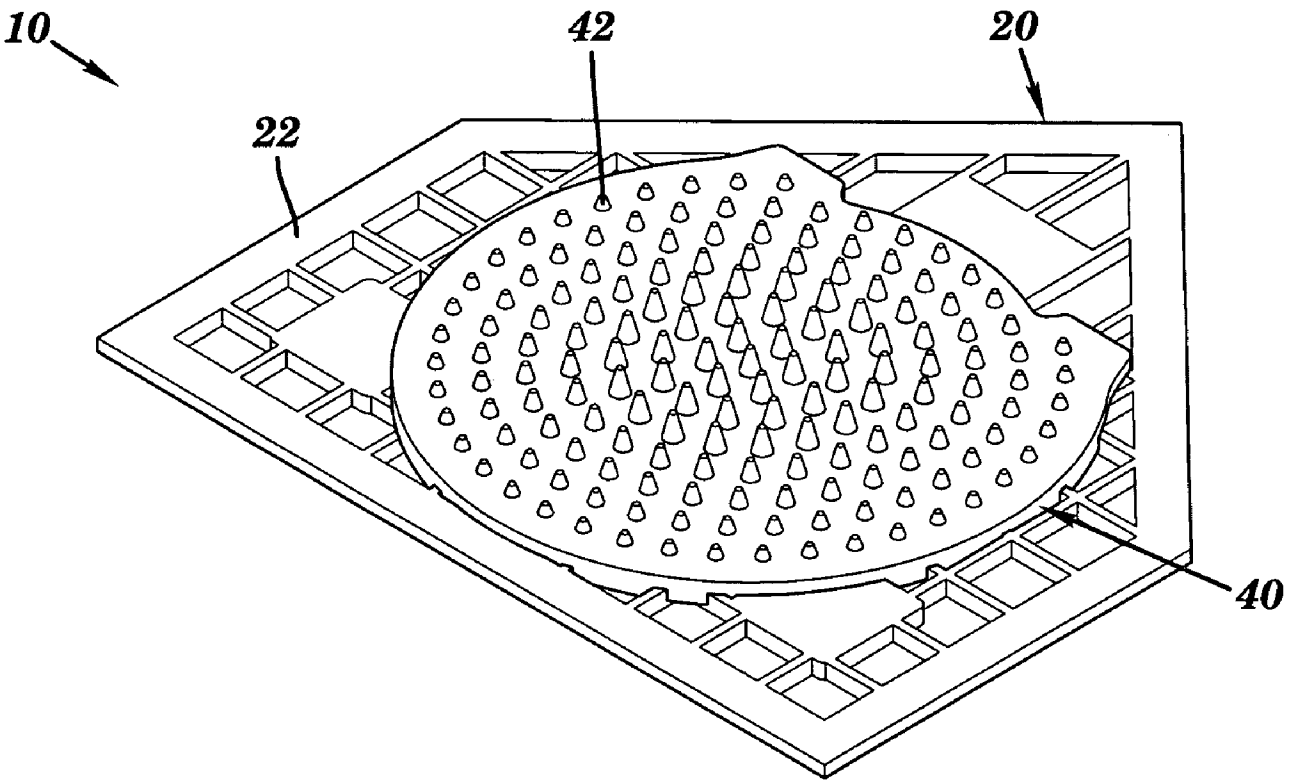
FIG. 2 is a bottom perspective view of the home plate of FIG. 1.
Figure 3:
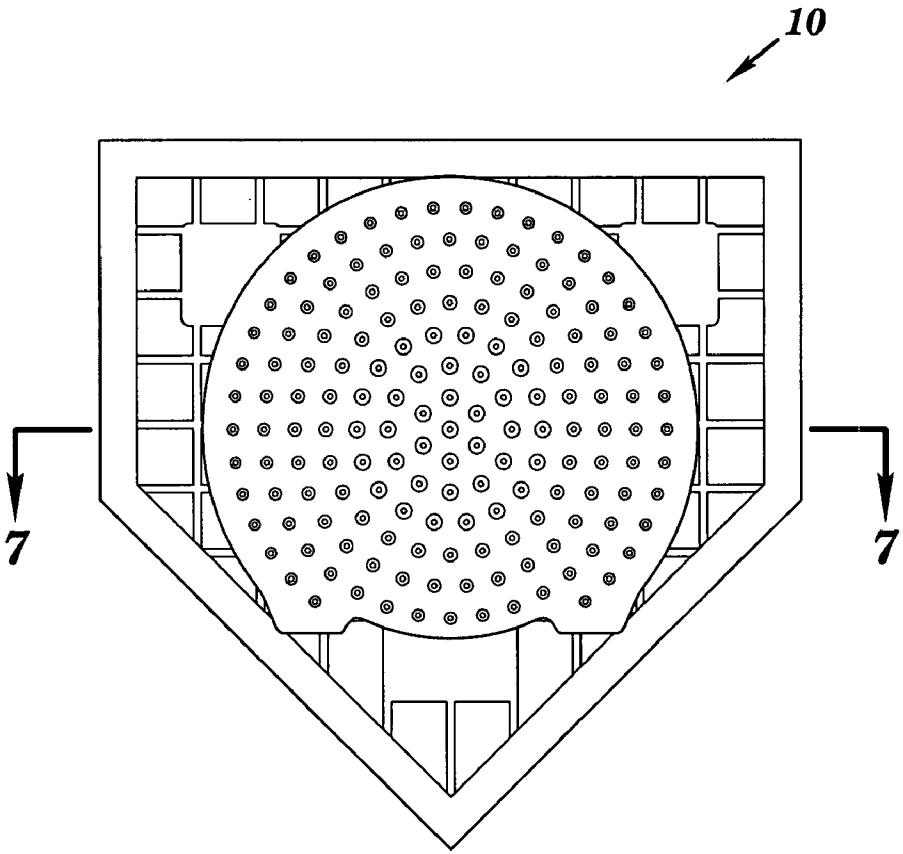
FIG. 3 is a bottom plan view of the home plate of FIG. 1.
Figure 4:
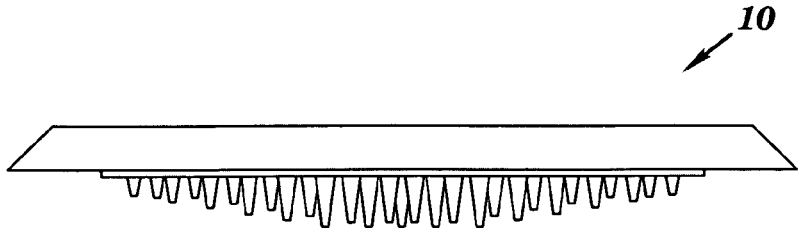
FIG. 4 is a rear elevational view of the home plate of FIG. 1.
Figure 5:
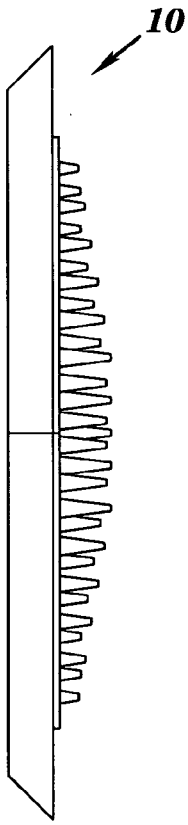
FIG. 5 is a side elevational view of the home plate of FIG. 1.
Figure 6:
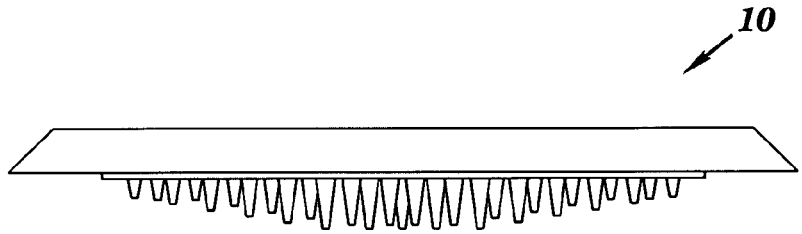
FIG. 6 is a front elevational view of the home plate of FIG. 1.
Figure 7:
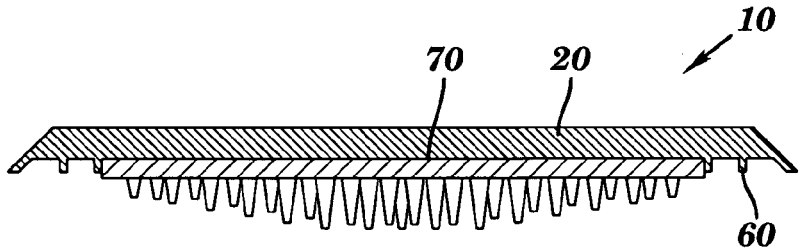
FIG. 7 is a cross-sectional view of the home plate taken along line 7-7 in FIG. 3.
Figure 8:
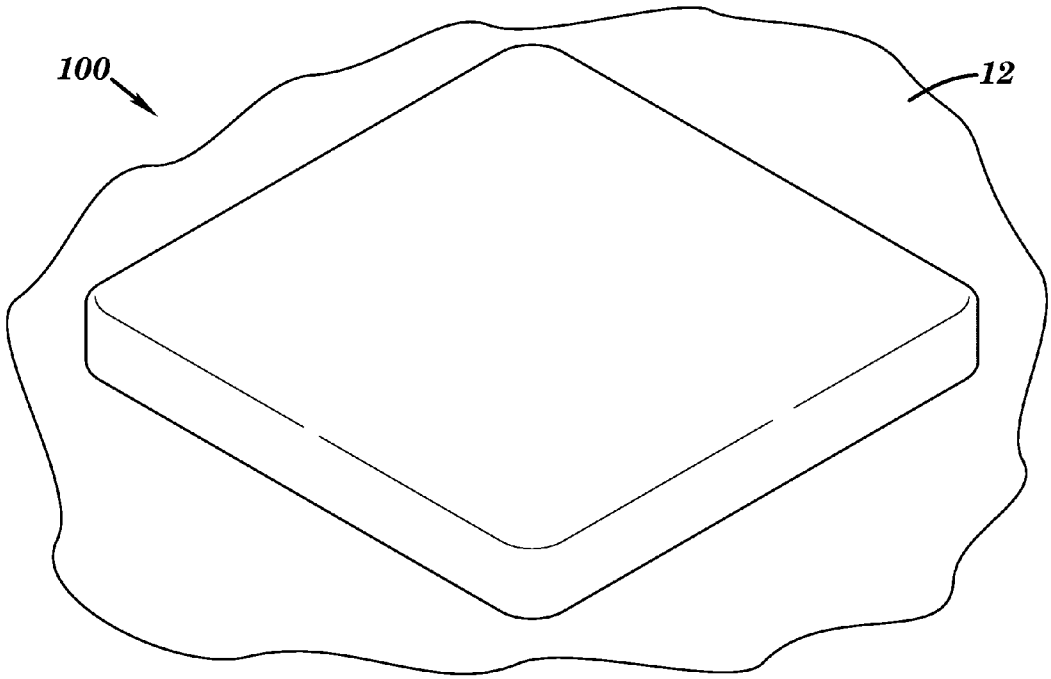
FIG. 8 is a front perspective view of a base such as a first base, a second base, and a third base, in accordance with the present invention.
Figure 9:
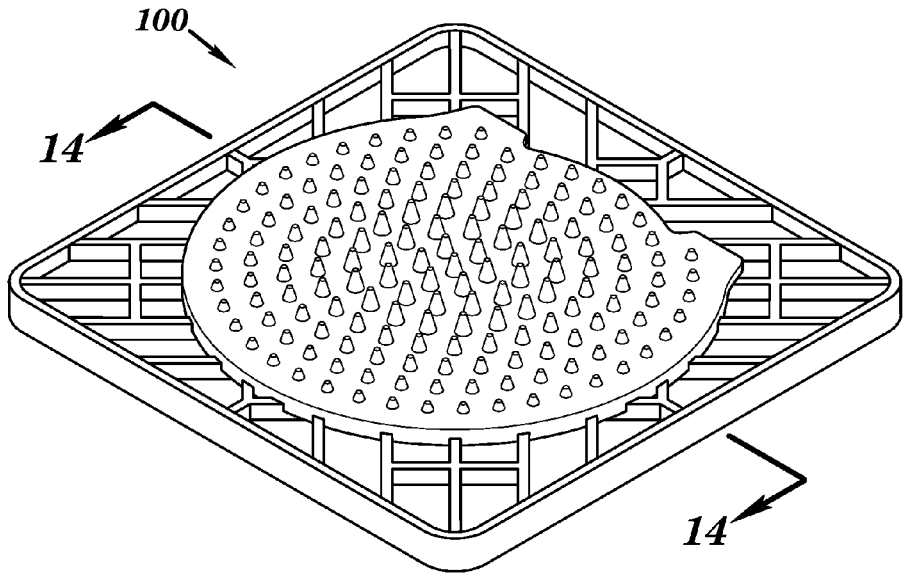
FIG. 9 is a bottom perspective view of the base of FIG. 8.
Figure 10:
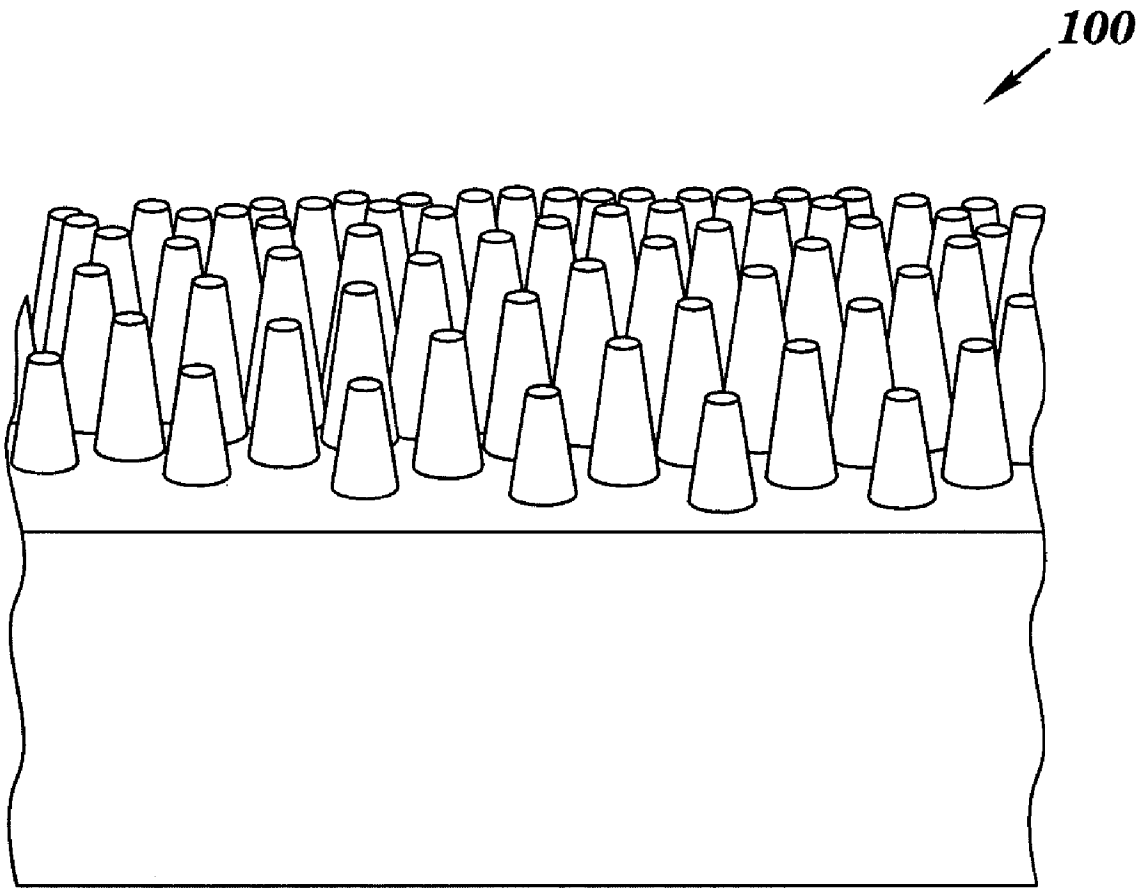
FIG. 10 is an enlarged, partial side elevational view of the base of FIG. 8.
Figure 11:
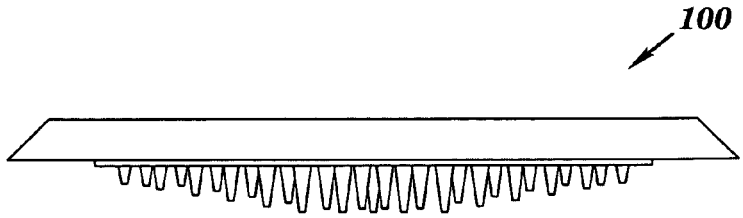
FIG. 11 is a rear elevational view of the base of FIG. 8.
Figure 12:
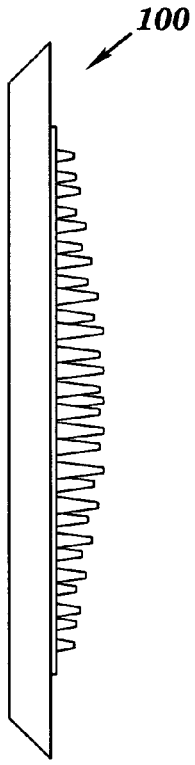
FIG. 12 is a side elevational view of the base of FIG. 8.
Figure 13:
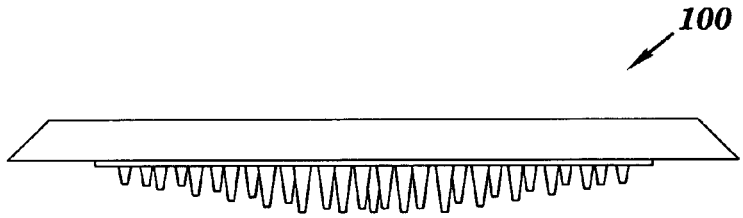
FIG. 13 is a front elevational view of the base of FIG. 8.
Figure 14:
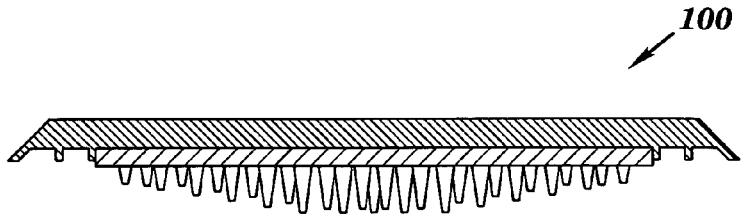
FIG. 14 is a cross-sectional view of the base taken along line 13-13 in FIG. 9.

In one embodiment, the present invention is directed generally to a set of devices for playing baseball or softball, which may include a first base, a second base, a third base, a home plate, and a pitcher's rubber. The devices are desirably used on the surface of synthetic turf infill material. The devices have multiple resilient projections on the bottom that engage with and dig into the infill material such as synthetic grass fibers and prevent the device from moving during normal play. The devices such as the bases pop out when a player slides into them in order to minimize injuries.

FIGS. 1-7 illustrate one embodiment of a device 10 such as a home plate in accordance with the present invention for use on synthetic turf infill material 12 which may include an upper portion 20 in the shape of a home plate and a generally circular lower portion 40 having a plurality of resilient downwardly-depending projections 42. The upper portion may have a thickness of about 1 inch.

The resilient downwardly-depending projections may vary in length and extend about ½ inch to about 1 inch in length from a bottom surface 22 of the upper portion, and desirably extend greater than ½ inch below a bottom surface of the upper portion, and are designed to anchor the device onto different types of playing surfaces. The resilient downwardly-depending projections may be generally fustoconically shaped and have an upper diameter of about ¼ inch and a lower distal diameter of about ⅛ inch. The device while desirable for synthetic playing surfaces may also be used on natural grass for a variety of sports. The device is free from traditional anchors in that the devise does not need a permanent sleeve embedded into the field for use. The resilient downwardly-depending projections are designed to hold the base onto the playing surface during normal play but also allow it to move if forced.

For example, the resilient downwardly-depending projections may be disposed in the center and may have a longer length than the length of the projections disposed adjacent to the peripheral edge of the base. In addition, the upper portion 20 may be formed with a plurality of ribs 60 (best shown in FIG. 7) for strengthening the upper portion and may include a recessed cavity 70 (FIG. 7) for receiving a portion of the lower portion having the resilient downwardly-depending projections.

The upper portion and the lower portion may be formed from the same material. For example, the upper portion may be fabricated from a resilient material such as styrene butadiene rubber (SBR), and the lower portion may be fabricated from a resilient material such styrene butadiene rubber (SBR). It will be appreciated that other suitable materials may be employed such as plastic or elastomeric materials. In another embodiment, the upper portion may be formed from a first material and the lower portion may be formed from a second material. The second material may be more resilient than the first material.

The lower portion may be attached to the upper portions using screws and/or adhesive. In another embodiment, the upper portion may be molded in a first mold. Thereafter, the upper portion may be placed in a second mold for molding the lower portion having projections onto the plate portion, e.g., using an overmolding process.

FIGS. 8-14 illustrate another embodiment of the invention for the device in the form of a base 100 such as a first base, a second base, and/or a third base in accordance with the present invention for use in playing baseball or softball on synthetic turf infill material 12. Base 100 is essentially similar to the home plate disclosed above, but with the exception of being configured as a base, e.g., being about 15 inches by about 15 inches, and having a thickness of about 3 inches. The upper portion may be formed from a plastic material, or material as noted above, or other suitable materials such as a cushioning material surrounded by a fabric material.

Figure 15:
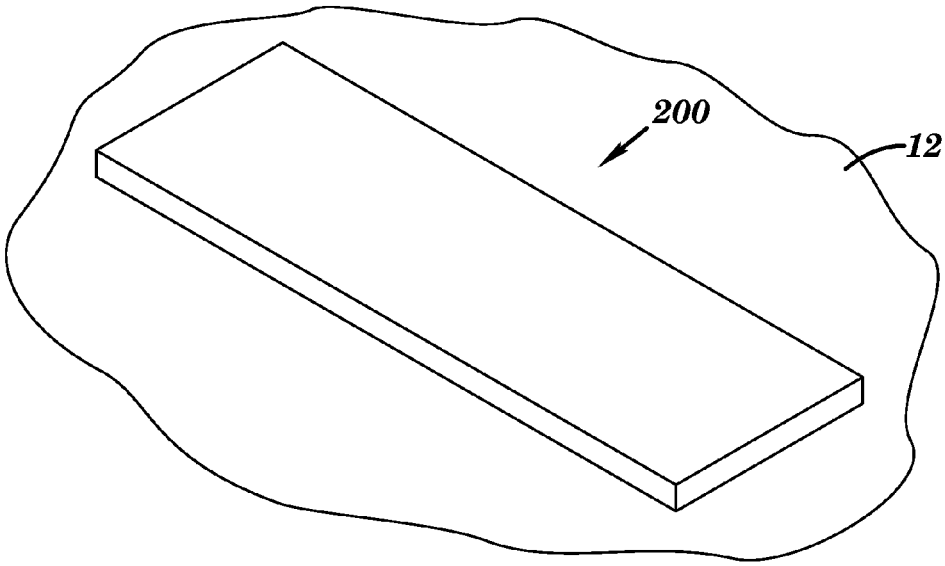
FIG. 15 is a front perspective view of a pitcher's rubber in accordance with the present invention.
Figure 16:
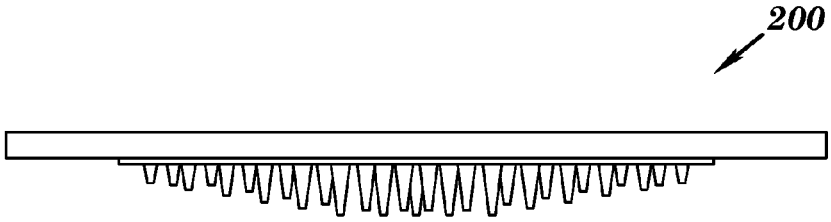
FIG. 16 is a front elevational view of the pitcher's rubber of FIG. 14.

FIGS. 15 and 16 illustrate another embodiment of the invention of the device in the form of a pitcher's rubber 200 in accordance with the present invention for use in playing baseball or softball on synthetic turf infill material 12. Pitcher's rubber 200 is essentially similar to the home plate and base disclosed above, but with the exception of being configured as a pitcher's rubber, e.g., being about 6 inches by 24 inches, and having a thickness of about 1 inch. The upper portion may be formed from a rubber or rubber-like material such as that as typically used for pitcher's rubbers, or the material noted above, or other suitable materials.

Although the invention has been particularly shown and described with reference to certain preferred embodiments, it will be readily appreciated by those of ordinary skill in the art that various changes and modifications may be made therein, without departing from the spirit and scope of the invention.

The invention claimed is:

1. A device for use as at least one of a base and a home plate on a synthetic turf infill material for playing baseball, said device comprising:

an upper portion in the shape of said at least one of the base and the home plate;

a lower portion comprising a plurality of downwardly-depending projections extending about ½ inch to about 1 inch below a bottom surface of said upper portion, and a length of said downwardly-depending projections being greater than a width of said downwardly-depending projections, and wherein a bottom portion of said upper portion comprises a recessed cavity for receiving a portion of said lower portion; and wherein said plurality of downwardly-depending projections is engageable with the synthetic turf infill material for playing baseball.

2. The device of claim 1 wherein said lower portion comprises a density of said downwardly-depending projections of about 1 projection to about 2 projections per square inch.

3. The device of claim 1 wherein said downwardly-depending projections comprises a generally fustoconical shape.

4. The device of claim 3 wherein said downwardly-depending projections comprises an upper diameter of about ¼ inch and a lower distal diameter of about ⅛ inch.

5. The device of claim 1 wherein said downwardly-depending projections disposed in a center of said lower portion are longer than said downwardly-depending projections disposed adjacent to a peripheral edge of the device.

6. The device of claim 1 wherein said upper portion comprises a plurality of ribs for strengthening said upper portion.

7. The device of claim 1 wherein said lower portion is over-molded into said recessed cavity of said upper portion.

8. The device of claim 1 wherein said upper portion comprises a first material, said lower portion comprises a second material, and said second material being more resilient than said first material.

9. The device of claim 1 wherein said device comprises at least one of a first base, a second base, and a third base.

10. The device of claim 1 wherein said device comprises said home plate.

11. The device of claim 1 wherein said plurality of downwardly-depending projections extend greater than ½ inch to about 1 inch below the bottom surface of said upper portion.

12. The device of claim 1 wherein said downwardly-depending projections comprises a lower distal diameter of about ⅛ inch.

13. The device of claim 12 wherein said lower portion comprises a density of said downwardly-depending projections of about 1 projection to about 2 projections per square inch.

14. The device of claim 13 wherein said downwardly-depending projections disposed in a center of said lower portion are longer than said downwardly-depending projections disposed adjacent to a peripheral edge of the device.

15. The device of claim 14 wherein said lower portion is over-molded into said recessed cavity of said upper portion.

16. The device of claim 1 wherein said plurality of downwardly-depending projections is disposed normal relative to said bottom surface of said upper portion.

17. The device of claim 1 wherein said plurality of downwardly-depending projections generally define a pattern within a circle spaced from a peripheral edge of said upper portion.

18. The device of claim 1 wherein said plurality of downwardly-depending projections is generally arranged in a plurality of concentric circles.

19. The device of claim 1 wherein said plurality of downwardly-depending projections comprise a plurality of resilient downwardly-depending projections.

20. A kit for playing baseball on a synthetic field, the kit comprising:

three bases, said three bases comprising:

an upper portion;

a lower portion comprising a plurality of downwardly-depending projections extending about ½ inch to about 1 inch below a bottom surface of said upper portion, and a length of said downwardly-depending projections being greater than a width of said downwardly-depending projections, and wherein a bottom portion of said upper portion comprises a recessed cavity for receiving a portion of said lower portion; and wherein said plurality of downwardly-depending projections is engageable with the synthetic turf infill material for playing baseball.

21. The kit of claim 20 wherein said plurality of downwardly-depending projections extend greater than ½ inch to about 1 inch below the bottom surface of said upper portion.

22. A kit for playing baseball on a synthetic filed, the kit comprising:

three bases, said three bases, and said pitcher's rubber comprising:

an upper portion;

a lower portion comprising a plurality of downwardly-depending projections extending about ½ inch to about 1 inch below a bottom surface of said upper portion, and a length of said downwardly-depending projections being greater than a width of said downwardly-depending projections, and wherein said downwardly-depending projections disposed in a center of said lower portion are longer than said downwardly-depending projections disposed adjacent to a peripheral edge of the device; and wherein said plurality of downwardly-depending projections is engageable with the synthetic turf infill material for playing baseball.

23. The baseball field of claim 22 wherein said plurality of downwardly-depending projections extend greater than ½ inch to about 1 inch below the bottom surface of said upper portion.

24. A home plate for use on synthetic turf infill material for playing baseball, said home plate comprising:

an upper portion;

a lower portion comprising a plurality of downwardly-depending projections extending about ½ inch to about 1 inch below a bottom surface of said upper portion, and said downwardly-depending projections comprising a density of about 1 projection to about 2 projections per square inch, and a length of said downwardly-depending projections being greater than a width of said downwardly-depending projections; and wherein a bottom portion of said upper portion comprises a recessed cavity for receiving a portion of said lower portion; and wherein said plurality of downwardly-depending projections is engageable with the synthetic turf infill material for playing baseball.

25. The home plate of claim 24 wherein said downwardly-depending projections disposed in a center of said lower portion are longer than said downwardly-depending projections disposed adjacent to a peripheral edge of the device.

26. The home plate of claim 24 wherein said lower portion is over-molded into said recessed cavity of said upper portion.

27. The home plate of claim 24 wherein said upper portion comprises a first material, said lower portion comprises a second material, and said second material being more resilient than said first material.

28. A kit for playing baseball on a synthetic field, the kit comprising:

a first base;

a second base;

a third base;

the home plate of claim 24; and a pitcher's rubber.

29. A baseball field comprising:

a synthetic turf infill material;

a first base;

a second base;

a third base;

the home plate of claim 24; and a pitcher's rubber.

30. The home plate of claim 24 wherein said plurality of downwardly-depending projections extend greater than ½ inch to about 1 inch below the bottom surface of said upper portion.

31. A pitcher's rubber for use on synthetic turf infill material for playing baseball, said pitcher's rubber comprising:

an upper portion;

a lower portion comprising a plurality of downwardly-depending projections extending about ½ inch to about 1 inch below a bottom surface of said upper portion, and said downwardly-depending projections comprising a density of about 1 projection to about 2 projections per square inch, and a length of said downwardly-depending projections being greater than a width of said downwardly-depending projections; and wherein a bottom portion of said upper portion comprises a recessed cavity for receiving a portion of said lower portion; and wherein said plurality of downwardly-depending projections is engageable with the synthetic turf infill material for playing baseball.

32. The pitcher's rubber of claim 31 wherein said lower portion is over-molded into said recessed cavity of said upper portion.

33. The pitcher's rubber of claim 31 wherein said upper portion comprises a first material, said lower portion comprises a second material, and said second material being more resilient than said first material.

34. A kit for playing baseball on a synthetic field, the kit comprising:

a first base;

a second base;

a third base;

a home plate; and the pitcher's rubber of claim 31.

35. A baseball field comprising:

a synthetic turf infill material;

a first base;

a second base;

a third base;

a home plate; and the pitcher's rubber of claim 31.

36. The pitcher's rubber of claim 31 wherein said plurality of downwardly-depending projections extend greater than ½ inch to about 1 inch below the bottom surface of said upper portion.

37. A device for use as at least one of a base, a home plate, and a pitcher's rubber on a synthetic turf infill material for playing baseball, said device comprising:

an upper portion in the shape of said at least one of the base, the home plate, and the pitcher's rubber;

a lower portion comprising a plurality of downwardly-depending projections extending about ½ inch to about 1 inch below a bottom surface of said upper portion, a length of said downwardly-depending projections being greater than a width of said downwardly-depending projections, and said downwardly-depending projections disposed in a center of said lower portion are longer than said downwardly-depending projections disposed adjacent to a peripheral edge of the device; and wherein said plurality of downwardly-depending projections is engageable with the synthetic turf infill material for playing baseball.

38. The device of claim 37 wherein said lower portion comprises a density of said downwardly-depending projections of about 1 projection to about 2 projections per square inch.

39. The device of claim 37 wherein said plurality of downwardly-depending projections extend greater than ½ inch to about 1 inch below the bottom surface of said upper portion.

40. The device of claim 37 wherein said plurality of downwardly-depending projections is disposed normal relative to said bottom surface of said upper portion.

41. The device of claim 37 wherein said downwardly-depending projections comprises a generally fustoconical shape.

42. The device of claim 41 wherein said downwardly-depending projections comprises an upper diameter of about ¼ inch and a lower distal diameter of about ⅛ inch.

43. The device of claim 37 wherein said upper portion comprises a plurality of ribs for strengthening said upper portion.

44. The device of claim 37 wherein a bottom portion of said upper portion comprises a recessed cavity for receiving a portion of said lower portion.

45. The device of claim 44 wherein said lower portion is over-molded into said recessed cavity of said upper portion.

46. The device of claim 37 wherein said upper portion comprises a first material, said lower portion comprises a second material, and said second material being more resilient than said first material.

47. The device of claim 37 wherein said at least one of a base, a home plate, and a pitcher's rubber is at least one of a first base, a second base, and a third base.

48. The device of claim 47 wherein said plurality of downwardly-depending projections are disposed generally define a pattern within a circle spaced from a peripheral edge of said upper portion.

49. The device of claim 37 wherein said plurality of downwardly-depending projections is generally arranged in a plurality of concentric circles.

50. The device of claim 37 wherein said at least one of a base a home slate and a pitcher's rubber is a home plate.

51. The device of claim 50 wherein said plurality of downwardly-depending projections are disposed generally define a pattern within a circle spaced from a peripheral edge of said upper portion.

52. The device of claim 51 wherein said plurality of downwardly-depending projections is generally arranged in a plurality of concentric circles.

53. The device of claim 37 wherein said at least one of a base, a home plate, and a pitcher's rubber is a pitcher's rubber.

* * * * *

UNITED STATES PATENT AND TRADEMARK OFFICE

CERTIFICATE OF CORRECTION

PATENT NO. : 8,337,340 B2
APPLICATION NO. : 12/371848
DATED : December 25, 2012
INVENTOR(S) : Burton Scott Clark It is certified that error appears in the above-identified patent and that said Letters Patent is hereby corrected as shown below:

Claim 50, at Column 8, Line 24: insert --,-- after the word base

Claim 50, at Column 8, Line 24: Delete "slate" and insert -- plate --

Claim 50, at Column 8, Line 24: insert --,-- after the word plate

Signed and Sealed this
Twelfth Day of March, 2013

Teresa Stanek Rea
*Acting Director of the United States Patent and Trademark Office*